US006638016B1

(12) United States Patent
Mease et al.

(10) Patent No.: US 6,638,016 B1
(45) Date of Patent: Oct. 28, 2003

(54) AIR MOVER ASSEMBLY AND METHOD FOR ENCLOSING AN AIR MOVER

(75) Inventors: Keith D. Mease, Gibbstown, NJ (US); Norman K. Newman, Hatfield, PA (US)

(73) Assignee: Unisys Corporation, Blue Bell, PA (US)

( * ) Notice: Subject to any disclaimer, the term of this patent is extended or adjusted under 35 U.S.C. 154(b) by 54 days.

(21) Appl. No.: 10/016,582

(22) Filed: Oct. 31, 2001

(51) Int. Cl.[7] ..... F04D 29/40
(52) U.S. Cl. ..... 415/214.1; 415/220
(58) Field of Search ..... 415/213.1, 214.1, 415/215.1, 220, 204, 219.1, 108, 206; 403/13, 326, 329; 361/688, 690, 692, 695, 696, 697

(56) References Cited

U.S. PATENT DOCUMENTS 6,099,258 A * 8/2000 Litvin et al. ..... 416/247 R
6,364,618 B1 * 4/2002 Moreno ..... 416/247 R

* cited by examiner

*Primary Examiner*—Edward K. Look
*Assistant Examiner*—Dwayne J White
(74) *Attorney, Agent, or Firm*—Lise A. Rode; Mark T. Starr; Ratner Prestia

(57) ABSTRACT

An air mover assembly is provided including at least one air mover and enclosure portions together defining a space to accommodate one or more air movers. Each of the enclosure portions has an engagement surface, and the engagement surfaces are configured for interengagement with one another to resist separation of the enclosure portions without the use of fasteners. A corresponding method is also provided.

20 Claims, 4 Drawing Sheets

AIR MOVER ASSEMBLY AND METHOD FOR ENCLOSING AN AIR MOVER

FIELD OF THE INVENTION

This invention relates to air movers. More specifically, this invention relates to an assembly and method for retaining an air mover within an enclosure.

BACKGROUND OF THE INVENTION

Air movers such as fan modules are often used in electronic assemblies to provide cooling and to dissipate the heat generated by components of the electronic assemblies. Fasteners are frequently utilized to achieve component alignment in such modules, and also to secure the components in place. The various hardware and torquing requirements associated with many fasteners add significantly to the time and costs associated with assembling fan modules.

Accordingly, there remains a need for improved air mover assemblies that can be provided at reduced costs with reduced labor by reducing or eliminating the need for fasteners.

SUMMARY OF THE INVENTION

According to one aspect, this invention provides an air mover assembly including at least one air mover and enclosure portions together defining a space to accommodate one or more air movers. Each of the enclosure portions has an engagement surface, and the engagement surfaces of the respective enclosure portions are configured for interengagement with one another to resist separation of the enclosure portions without the use of fasteners.

According to another aspect, this invention provides an air mover assembly including at least one air mover and enclosure portions together defining a space to accommodate one or more air movers. Each of the enclosure portions has an engagement surface, and the engagement surfaces of the respective enclosure portions are configured for interengagement with one another to resist separation of the enclosure portions. The engagement surface of one of the enclosure portions is provided by a detent formed on an extension, and the engagement surface of another one of the enclosure portions is defined by a recess formed in that other enclosure portion, whereby the detent is configured to extend at least partially into the recess.

According to yet another aspect, this invention also provides a method for enclosing an air mover without the use of fasteners. The air mover is first interposed between enclosure portions. An engagement surface of one enclosure portion is then interengaged with an engagement surface of a second enclosure portion, thereby resisting separation of the enclosure portions, and thereby eliminating the use of fasteners to interengage the enclosure portions.

According to still another aspect, this invention also provides a method for enclosing an air mover. The air mover is first interposed between enclosure portions. An extension of one enclosure portion is then positioned adjacent a recess formed in a second enclosure portion. A detent on the extension of the one enclosure portion is inserted within the recess of the second enclosure portion. An engagement surface of the detent of the extension of the one enclosure portion is then interengaged with an engagement surface of the recess in the second enclosure portion, thereby resisting separation of the enclosure portions.

BRIEF DESCRIPTION OF THE DRAWINGS

The invention will be described with reference to the exemplary embodiments illustrated in the figures, of which.

DETAILED DESCRIPTION OF THE INVENTION

Preferred features of embodiments of this invention will now be described with reference to the figures. It will be appreciated that the spirit and scope of the invention is not limited to the embodiments selected for illustration. Also, it should be noted that the drawings are not rendered to any particular scale or proportion. It is contemplated that any of the configurations and materials described hereafter can be modified within the scope of this invention.

It has been discovered that significant advantages can be enjoyed when the number of fasteners used in component assemblies can be reduced or even eliminated. It is recognized that the use of fasteners incurs the cost of the fasteners themselves as well as the labor required to install the fasteners. This invention, therefore, makes it possible to reduce the number of fasteners used in an assembly.

Generally referring to FIGS. 1–4B, this invention provides an air mover assembly 10 including at least one air mover 12 and enclosure portions 14A and 14B together defining a space to accommodate one or more air movers 12. Each of the enclosure portions 14A and 14B has an engagement surface such as engagement surface 34A or engagement surface 36A, for example. The engagement surfaces 34A and 36A are configured for interengagement with one another to resist separation of the enclosure portions 14A and 14B without the use of fasteners.

This invention also provides a method for enclosing an air mover such as air mover 12 without the use of fasteners. The air mover 12 is first interposed between enclosure portions 14A and 14B. An engagement surface such as engagement surface 34A of one enclosure portion 14A is then interengaged with an engagement surface such as engagement surface 36A of a second enclosure portion 14B, thereby resisting separation of the enclosure portions 14A and 14B, and thereby eliminating the use of fasteners to interengage the enclosure portions.

Figure 1:
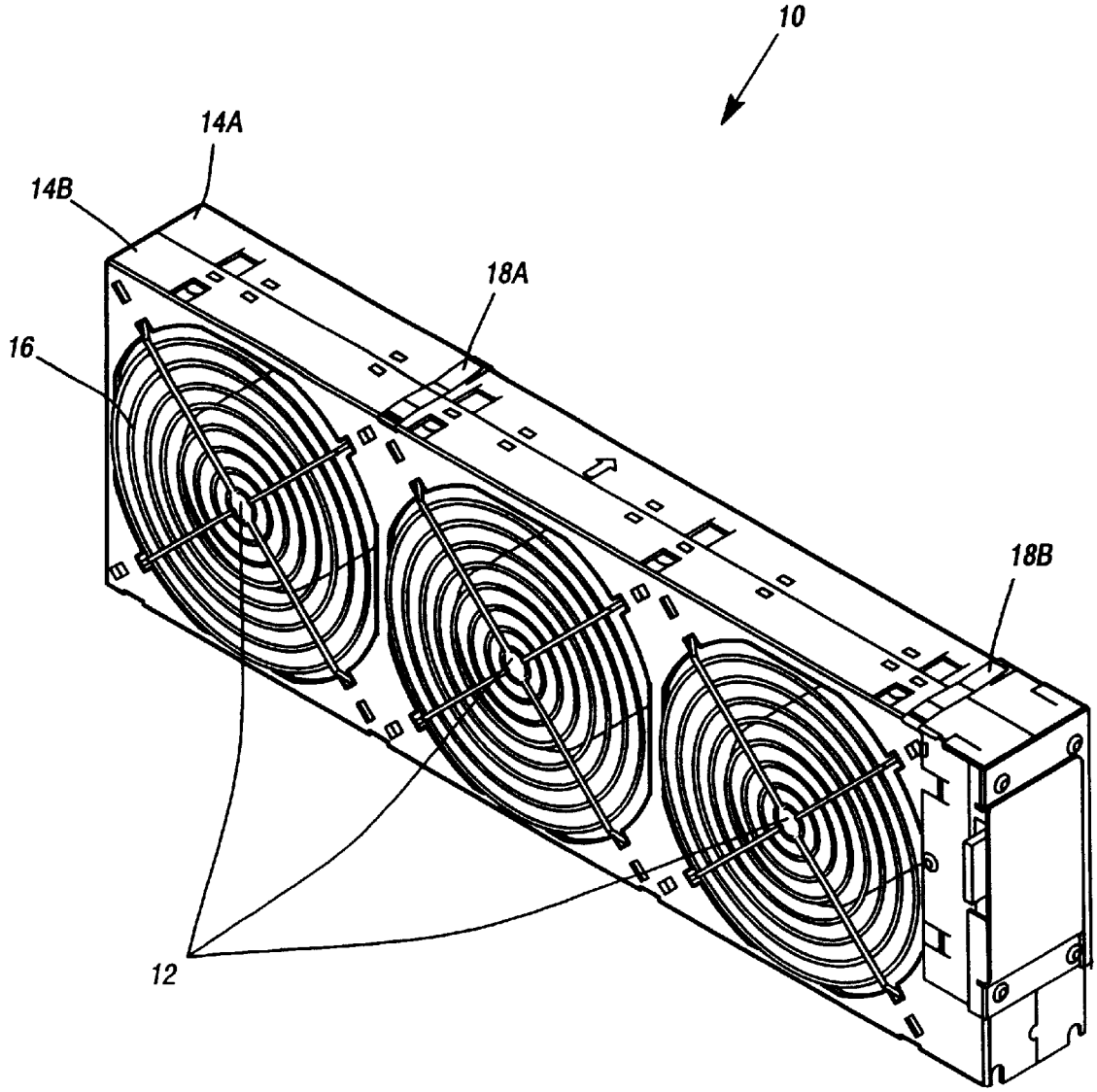
FIG. 1 is a front perspective view of an embodiment of an air mover assembly according to aspects of this invention.

Referring specifically to FIG. 1, an exemplary embodiment of an air mover assembly according to this invention is illustrated. The air mover assembly 10 includes air movers 12 (three shown in this example), which are enclosed in a space or spaces defined by enclosure portions 14A and 14B. Air mover assembly 10 also includes safety guards 16 (three shown in this example) which help to prevent contact with the air movers 12 within the enclosure portions 14A and 14B.

Handles 18A and 18B are also provided as components of the air mover assembly 10. Such handles 18A and 18B help facilitate the manipulation of the air mover assembly 10 as it is installed or extracted from an electronic assembly such as a computer. Additional details of handles 18A and 18B can be found in co-pending U.S. patent application Ser. No. 10/016,097, filed Oct. 31, 2001, which is entitled MODU- LAR COMPUTER SYSTEM AND LATCHING HANDLE FOR SAME, which application is incorporated herein by reference.

As is illustrated in FIG. 1, the air mover assembly 10 is useful for moving air in a direction corresponding to the arrow shown on the air mover assembly 10, which arrow is marked "AIR FLOW." Specifically, the arrow is provided on the top, middle surface of enclosure portion 14A in this exemplary embodiment of the invention.

Figure 2:
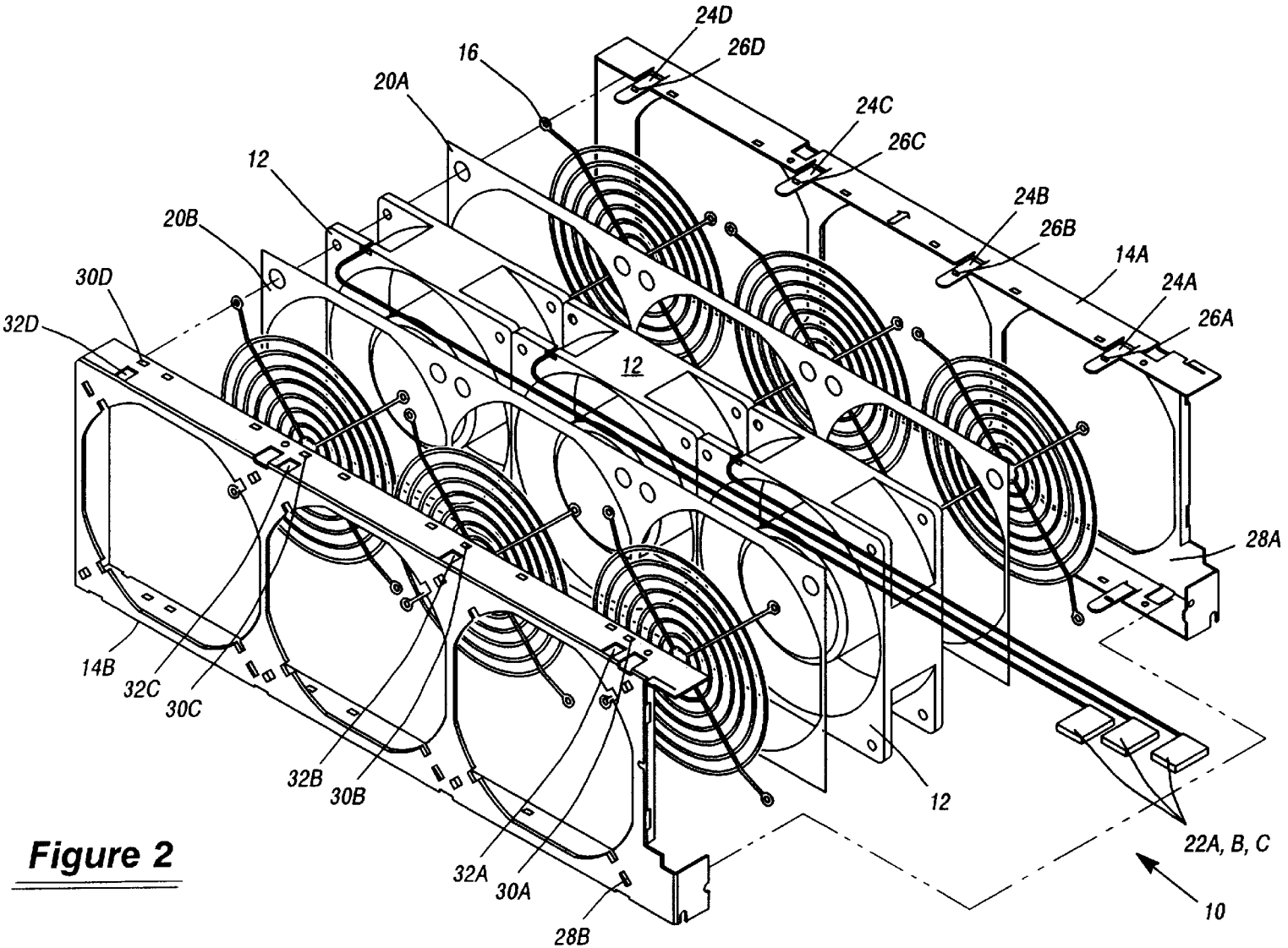
FIG. 2 is an exploded front perspective view of the air mover assembly illustrated in FIG. 1.

Referring now to FIG. 2, which provides an exploded front perspective view of the air mover assembly 10 illustrated in FIG. 1, exemplary components of the air mover assembly 10 will now be described. Interposed between enclosure portion 14A and enclosure portion 14B are a series of components arranged in layers. Positioned adjacent each of enclosure portions 14A and 14B is a series of safety guards 16 which, as described previously, help to prevent access to the air movers 12 mounted within the air mover assembly 10.

Gaskets 20A and 20B are then positioned adjacent the safety guards 16. Such gaskets 20A and 20B help to provide a seal to reduce the recirculation of air through the air mover assembly 10. The gaskets 20A and 20B also serve to dampen vibrations that may be generated by the operation of the air movers 12. Furthermore, the gaskets 20A and 20B help to keep the module assembly rigid by compensating for varying tolerances between adjacent components. In other words, due to the elasticity of the gasket material, the gaskets 20A and 20B may compress and expand as necessary to accommodate varying tolerances among adjacent components. Filling the gaps in such a way improves the sturdiness of the overall assembly. Gaskets 20A and 20B may be formed from foam rubber and may include an adhesive backing so as to adhere the gaskets 20A and 20B directly to the air movers 12 and/or enclosure portions 14A and 14B.

Sandwiched between gaskets 20A and 20B are the air movers 12. Air movers such as those illustrated in FIG. 2 are readily available and often include impellers which bring about air flow upon rotation with respect to the housing of the air mover. Although air movers in the form of fans are illustrated in the exemplary embodiments shown in the figures, it will be appreciated that the air mover assembly 10 can be modified so as to include any component that is capable of moving air. It will also be recognized that the enclosure according to this invention can be utilized for housing other components (other than air movers), and that the benefits of this invention are applicable to any means for enclosing a space.

Also illustrated in FIG. 2 is a series of electrical connectors 22A, 22B, and 22C, each of which extends from a respective one of the air movers 12 for connection to a source of electrical power.

Enclosure portion 14A includes a series of extensions 24 (eight shown in this example), which extensions are positioned for engagement with surfaces of enclosure portion 14B as will be described in further detail with reference to FIG. 3. Extensions 24A, 24B, 24C, and 24D are designated in FIG. 2. Each of extensions 24A–24D is provided with a detent 26A, 26B, 26C, and 26D, respectively. Each detent 26A–26D provides an engagement surface which will also be described in further detail with reference to FIG. 3.

Enclosure portion 14A also includes a series of alignment members, such as alignment member 28A designated in FIG. 2, which facilitates alignment of the enclosure portion 14A with respect to the safety guard 16, gasket 20A, and one of the air movers 12. More specifically, alignment member 28A extends through a mounting portion or loop of safety guard 16, through an aperture formed in gasket 20A, and into a mounting hole provided in one of the air movers 12. It will be understood that alignment member 28A therefore facilitates alignment of those components and also retains those components in a predetermined position upon assembly. Alignment members such as member 28A can allow the reduction or elimination of fasteners needed for alignment purposes.

Still referring to FIG. 2, enclosure portion 14B includes a series of recesses 30 (eight shown in this example) such as designated recesses 30A, 30B, 30C, and 30D. As will be described in connection with FIG. 3, the recesses 30A–30D are sized, positioned, and configured to at least partially receive detents 26A–26D, respectively. It is the engagement between the engagement surfaces of detents 26A–26D and the engagement surfaces of recesses 30A–30D, respectively, that resists separation of enclosure portion 14A from enclosure portion 14B.

It will be appreciated that the interengagement of enclosure portions 14A and 14B by virtue of the features of those portions, can be achieved without the use of fasteners or with a reduced number of fasteners. For example, threaded fasteners such as screws or bolts or other threaded or un-threaded fasteners need not be used in the exemplary embodiments of the air mover assembly 10 illustrated in the figures. Alternatively, the features of the air mover assembly 10 make it possible to reduce the number of such fasteners, if such fasteners are used at all.

The exemplary embodiment of enclosure portion 14B illustrated in FIG. 2 also includes a series of supports 30 (eight shown in this example), such as designated supports 32A, 32B, 32C, and 32D, each of which is positioned to extend adjacent to surfaces of extensions 24A–24D, respectively. In this manner, the supports 32A–32D help to resist separation of the engagement surfaces of enclosure portion 14A from those of enclosure portion 14B. The manner in which the supports 32A–32D operate will be described in greater detail with reference to FIG. 3.

The enclosure portions 14A and 14B illustrated in FIG. 2 are preferably formed from a conductive material such as metal and, if formed from metal or other conductive material, can optionally be used to provide EMI/RFI shielding. More specifically, if enclosure portions 14A and 14B are formed from metal for example, they can be utilized to reduce the effects of electromagnetic interference and radio frequency interference, which interference may be generated by components within the enclosure portions 14A and 14B. If formed from a metal, enclosure portions 14A and 14B can be produced from sheet metal using stamping, bending, or other metal-forming processes.

Alternatively, enclosure portions 14A and 14B can be formed from non-metallic materials such as a conductive or non-conductive plastic material (e.g., polypropylene or another polymeric material). If so, enclosure portions 14A and 14B can be produced using injection molding, vacuum forming, or other known forming technologies.

Figure 3:
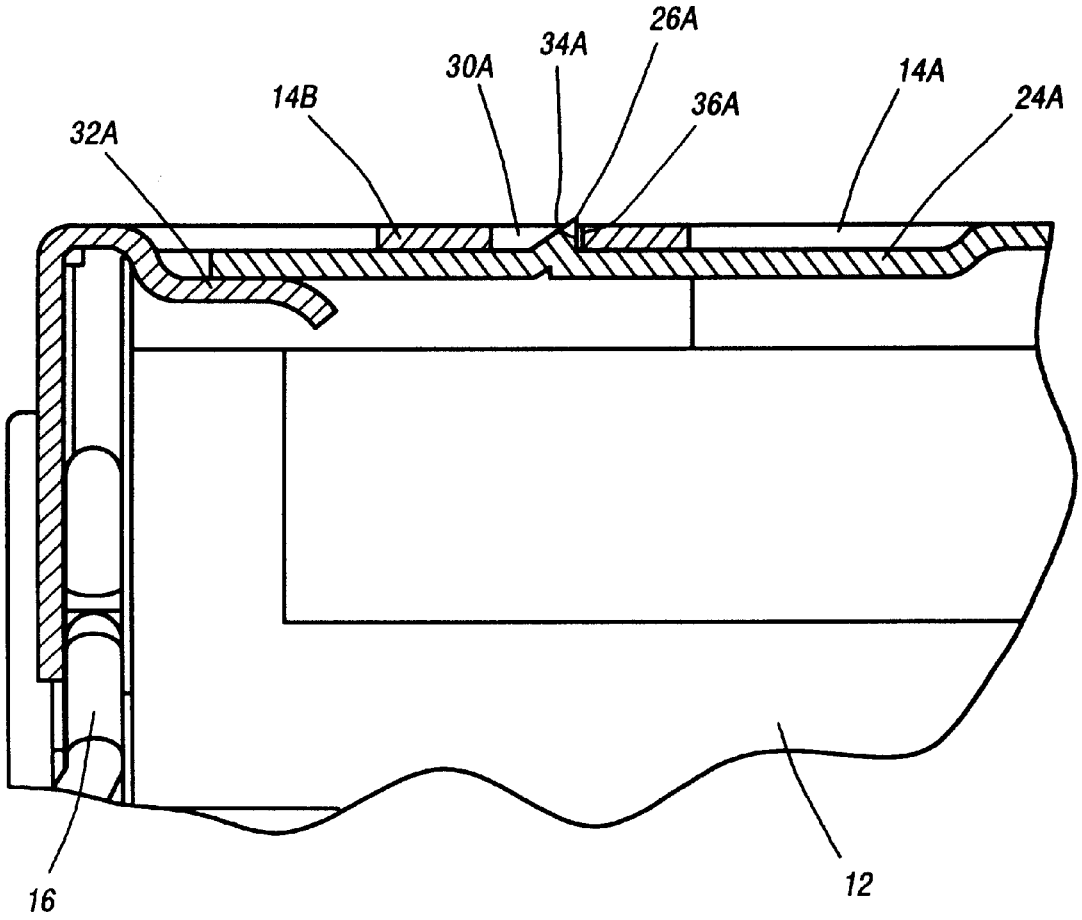
FIG. 3 is a cross-sectional side view of a portion of the air mover assembly illustrated in FIG. 1.

Referring now to FIG. 3, a cross-sectional side view of a portion of the air mover assembly 10 is shown in order to illustrate an exemplary manner in which enclosure portions such as portions 14A and 14B can be interengaged. As illustrated in FIG. 3, detent 26A formed on extension 24A of enclosure portion 14A extends into a recess 30A defined in a surface of enclosure portion 14B. Engagement surface 34A is defined by the detent 26A and engagement surface 36A is defined by the recess 30A. It is the interengagement between engagement surfaces 34A and 36A that resists separation of enclosure portions 14A and 14B.

The relationship between support 32A and extension 24A is also illustrated in FIG. 3. It will be understood that support 32A helps to maintain detent 26A of enclosure portion 14A within recess 30A of enclosure portion 14B. By resisting the separation of a facing surface of extension 24A from an inner surface of enclosure portion 14B, support 32A helps to maintain interference between the engagement surfaces 34A and 36A. In other words, support 32A is configured to retain extension 24A adjacent enclosure portion 14B, thereby securing detent 26A in position within recess 30A. The result is that engagement surfaces 34A and 36A are positioned to oppose separation of enclosure portions 14A and 14B.

In the exemplary embodiment illustrated in FIG. 3, support 32A has a curved entry surface in order to help receive the end of extension 24A as enclosure portions 14A and 14B are mated with respect to one another. Detent 26A is provided with a ramped forward surface which also helps to facilitate the assembly of the enclosure portions 14A and 14B. When the enclosure portions 14A and 14B are brought together such that the position of detent 26A corresponds to that of recess 30A, the detent 26A snaps into engagement with recess 30A, and the mating relationship between engagement surfaces 34A and 36A prevents or at least resists separation thereafter.

While the use of a support such as support 32A is beneficial, it is not necessary. Also, although the interengagement between enclosure portions 14A and 14B is realized through the use of an extension 24A and a recess 30A to form a snap-fit engagement, it will be appreciated that other configurations can be used to bring about mating engagement between the enclosure portions 14A and 14B. Nevertheless, the exemplary configuration illustrated in FIG. 3 helps to eliminate the need for fasteners (although fasteners can be used, if desired, to supplement the snap-fit engagement between enclosure portions 14A and 14B).

Figure 4A:
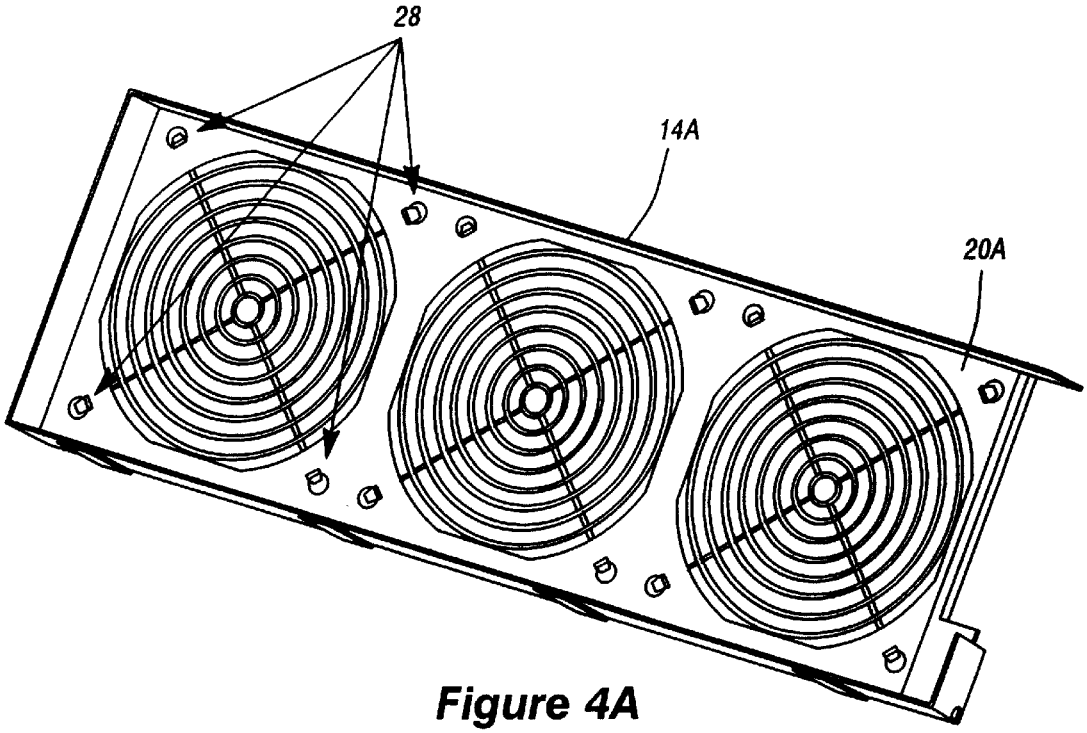
FIG. 4A is a front perspective view of a subassembly of components of the air mover assembly illustrated in FIG. 1.
Figure 4B:
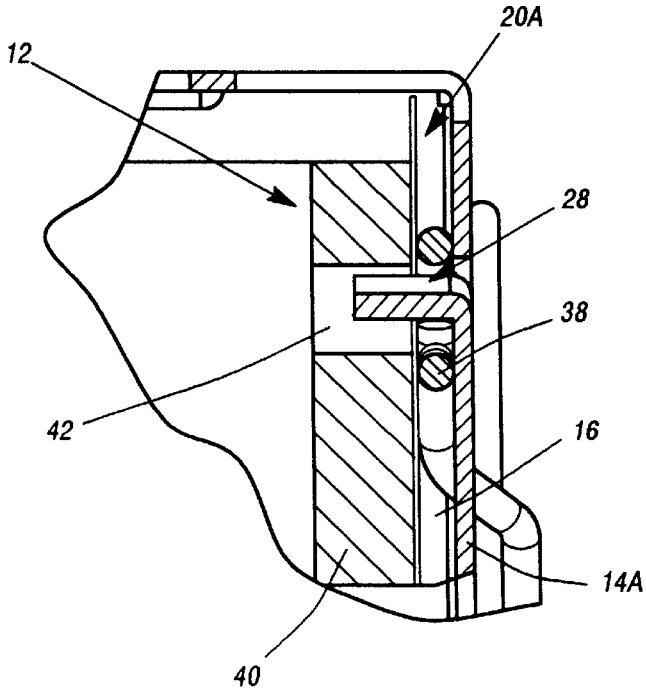
FIG. 4B is a cross-sectional side view of the subassembly illustrated in FIG. 4A.

Referring now to FIGS. 4A and 4B, an exemplary embodiment of alignment features according to this invention will now be described. As was discussed previously, it may be desirable to ensure alignment among the components of the air mover assembly to help facilitate their assembly and to help maintain a desired assembled condition.

FIG. 4A illustrates a sub-assembly of the air mover assembly 10, which sub-assembly includes enclosure portion 14A, safety guards 16, and a gasket 20A. Those components have been described previously with reference to FIG. 2.

Details of the alignment member 28 and the relationship between the alignment member 28 and the components shown in FIG. 4A are illustrated in FIG. 4B (with the addition of an air mover 12). More specifically, an alignment member 28, which can be formed, for example, by stamping a portion of enclosure portion 14A, extends inwardly toward the interior region of the air mover assembly 10. Alignment member 28 extends through a mounting loop 38 of the safety guard 16, through an aperture in the gasket 20A, and into an opening 42 located in a flange 40 of air mover 12. In this manner, a member such as alignment member 28 brings about alignment of the air mover 12, gasket 20A, and safety guard 16 with respect to enclosure portion 14A.

Although exemplary embodiments of the air mover assembly and method according to this invention have been described, there are others that support the spirit of the invention and are therefore within the contemplated scope of the invention. For example, in the described embodiment, the plane of contact between enclosure portions 14A and 14B is oriented substantially perpendicular to the flow of air through the air mover assembly 10. However, the plane of contact is not limited to such orientation, and may be positioned substantially parallel or at any other angle to the flow of air through the air mover assembly. Enclosure portions 14A and 14B may include apertures that accommodate EMI/RFI clips to enhance shielding effects. The material of the gaskets 20A and 20B is not limited to foam rubber, and may consist of plastic or other suitable material. The foregoing is considered as illustrative only of the many possible variations in the illustrated configurations of the air mover assembly, and the foregoing recitation of variations should not be considered to be an exhaustive list.

It will be appreciated that other modifications can be made to the illustrated embodiments without departing from the scope of the invention. The scope of the invention is separately defined in the appended claims.

What is claimed:

1. An air mover assembly comprising:

at least one air mover having a housing and an impeller positioned at least partially within said housing; and enclosure portions together defining a space to accommodate said air mover, said enclosure portions each having an engagement surface, said engagement surfaces being configured for interengagement with one another to resist separation of said enclosure portions without the use of fasteners.

2. The air mover assembly recited in claim 1, wherein said engagement surface of one enclosure portion is provided by an extension, said extension being positioned adjacent said engagement surface of another enclosure portion.

3. An air mover assembly comprising:

at least one air mover; and enclosure portions together defining a space to accommodate said air mover, said enclosure portions each having an engagement surface, said engagement surfaces being configured for interengagement with one another to resist separation of said enclosure portions without the use of fasteners;

wherein said engagement surface of one enclosure portion is provided by an extension, said extension being positioned adjacent said engagement surface of another enclosure portion; and said another enclosure portion comprises a support positioned to urge said extension of said one enclosure portion into engagement with said engagement surface of said another enclosure portion.

4. The air mover assembly recited in claim 3, wherein at least one of said enclosure portions comprises an alignment member positioned to align said enclosure portion with said air mover.

5. The air mover assembly recited in claim 3, wherein said engagement surfaces are configured for snap-together engagement.

6. The air mover assembly recited in claim 3, wherein said assembly further comprises at least one safety guard positioned to discourage contact with said air mover.

7. The air mover assembly recited in claim 3, wherein said air mover comprises a fan.

8. The mover assembly recited in claim 3, wherein one of said enclosure portions is positioned upstream of said air mover and another of said enclosure portions is positioned downstream of said air mover.

9. The air mover assembly recited in claim 3, wherein said air mover assembly defines a plane of contact between said enclosure portions that is oriented substantially perpendicular to a flow of air through said air mover assembly.

10. The air mover assembly recited in claim 3, wherein said engagement surface of said one enclosure portion is provided by a detent on said extension.

11. The air mover assembly recited in claim 10, wherein said engagement surface of said another enclosure portion is defined by a recess formed in said another enclosure portion, and where said detent is configured to extend at least partially into said recess.

12. The air mover assembly recited in claim 10, wherein said enclosure portions are formed from a conductive material.

13. An air mover assembly comprising:

at least one air mover;

enclosure portions together defining a space to accommodate said air mover, said enclosure portions each having an engagement surface, said engagement surfaces being configured for interengagement with one another to resist separation of said enclosure portions without the use of fasteners; and a gasket interposed between at least one of said enclosure portions and said air mover.

14. An air mover assembly comprising:

at least one air mover; and enclosure portions together defining a space to accommodate said air mover, said enclosure portions each having an engagement surface, said engagement surfaces being configured for interengagement with one another to resist separation of said enclosure portions without the use of fasteners;

wherein said enclosure portions are formed from a conductive material; and said conductive enclosure portions provide EMI/RFI shielding.

15. An air mover assembly comprising:

at least one air mover; and enclosure portions together defining a space to accommodate said air mover, said enclosure portions each having an engagement surface, said engagement surface being configured for interengagement with one another to resist separation of said enclosure portions;

wherein said engagement surface of one of said enclosure portions is provided by a detent formed on an extension, said engagement surface of another one of said enclosure portions is defined by a recess formed in said another enclosure portion, and said detent of said one enclosure portion is configured to extend at least partially into said recess of said another enclosure portion; and said another enclosure portion comprises a support positioned to urge said extension of said one enclosure portion into engagement with said engagement surface of said another enclosure portion.

16. A method for enclosing an air mover without the use of fasteners, said method comprising the steps of:

interposing an air mover between enclosure portions;

interengaging an engagement surface of one enclosure portion with an engagement surface of a second enclosure portion, thereby resisting separation of the enclosure portions, and thereby eliminating the use of fasteners to interengage the enclosure portions; and aligning at least one of the enclosure portions with the air mover using at least one alignment member.

17. The method recited in claim 16, said interengaging step comprising positioning an extension defining the engagement surface of the one enclosure portion adjacent the engagement surface of the second enclosure portion.

18. The method recited in claim 17, said interengaging step further comprising engaging a detent of the extension with a recess of the second enclosure portion.

19. The method recited in claim 16, said interengaging step further comprising snapping together the engagement surfaces.

20. A method for enclosing an air mover, said method comprising the steps of:

interposing a housing and an impeller of an air mover between enclosure portions;

positioning an extension of one enclosure portion adjacent a recess formed in a second enclosure portion;

inserting a detent on the extension of the one enclosure portion within the recess of the second enclosure portion; and interengaging an engagement surface of the detent of the extension of the one enclosure portion with an engagement surface of the recess in the second enclosure portion, thereby resisting separation of the enclosure portions.

* * * * *